US009144809B2

(12) United States Patent
Huang

(10) Patent No.: US 9,144,809 B2
(45) Date of Patent: Sep. 29, 2015

(54) IMPINGEMENT SPRINKLER

(71) Applicant: Tzu-Lin Huang, Xianxi Township, Changhua County (TW)

(72) Inventor: Tzu-Lin Huang, Xianxi Township, Changhua County (TW)

( * ) Notice: Subject to any disclaimer, the term of this patent is extended or adjusted under 35 U.S.C. 154(b) by 435 days.

(21) Appl. No.: 13/623,991

(22) Filed: Sep. 21, 2012

(65) Prior Publication Data

US 2014/0042244 A1 Feb. 13, 2014

(30) Foreign Application Priority Data

Aug. 10, 2012 (TW) ..... 101215403 U

(51) Int. Cl.

| | |
|---|---|
| ***B05B 3/02*** | (2006.01) |
| ***B05B 3/14*** | (2006.01) |
| ***B05B 3/00*** | (2006.01) |
| ***B05B 3/04*** | (2006.01) |
| ***B05B 3/16*** | (2006.01) |
| ***B05B 15/06*** | (2006.01) |

(52) U.S. Cl.

CPC ..... *B05B 3/0477* (2013.01); *B05B 3/0481* (2013.01); *B05B 3/165* (2013.01); *B05B 15/066* (2013.01)

(58) Field of Classification Search

CPC .... B05B 3/0477; B05B 3/0481; B05B 3/165; B05B 15/066

USPC ..... 239/230, 225.1

See application file for complete search history.

(56) References Cited

U.S. PATENT DOCUMENTS

| | | | | | |
|---|---|---|---|---|---|
| 2,309,782 | A * | 2/1943 | Orr | ..... | 239/233 |
| 2,928,608 | A * | 3/1960 | Royer | ..... | 239/230 |
| 3,841,563 | A * | 10/1974 | Lockwood | ..... | 239/230 |
| 4,231,522 | A * | 11/1980 | Drechsel | ..... | 239/233 |
| 4,907,742 | A * | 3/1990 | Whitehead et al. | ..... | 239/230 |
| 5,353,989 | A * | 10/1994 | Drechsel | ..... | 239/230 |
| 8,382,009 | B2 * | 2/2013 | Wang | ..... | 239/236 |

* cited by examiner

*Primary Examiner* — Len Tran
*Assistant Examiner* — Alexander Valvis
(74) *Attorney, Agent, or Firm* — Egbert Law Offices, PLLC

(57) ABSTRACT

An impingement sprinkler has a main body, a rotation guiding mechanism, a slant adjustment mechanism, a turning control component and a rotation limiting mechanism. The rotation limiting mechanism has a first limiting piece and a second limiting piece. The main body has a frame portion and a sprinkler head. The rotation guiding mechanism includes a torsional spring and a swinging piece. The swinging piece has a first contacting portion. The turning control component has a second contacting piece and a poking rod portion. The poking rod portion always contacts the stopping portions such that the first and second limiting pieces interfere with the poking rod portion.

6 Claims, 8 Drawing Sheets

IMPINGEMENT SPRINKLER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an impingement sprinkler, and more particularly to an innovative one which, through the first and second stopping portions extensionally formed on the first and second limiting pieces, can substantially execute the turning action when the slanting angle of the main body is adjusted.

2. Description of Related Art Including Information Disclosed Under 37 CFR 1.97 and 37 CFR 1.98

Impingement sprinklers are widely used in large-area crop irrigation and gardening because impingement sprinklers are capable of recycling or reciprocating irrigation in a circular area coverage. To further enhance the utility of the impingement sprinklers, manufacturers have developed impingement sprinklers with an adjustable slanting angle. By adjusting upward or downward, the sprinkling angle of the impingement sprinkler can be changed (i.e., when slanting upward, the sprinkling distance of the parabolic water flow is large, while when slanting downward, the distance is small), so as to meet diversified requirements of the users. What is discussed in the present invention is to improve the turning mechanism of such impingement sprinklers with adjustable slanting angle.

The structure of a conventional impingement sprinkler is usually made up of a main body, a water connection pipe provided on the bottom of the main body, a swinging frame, a turning mechanism, and a slanting and turning structure arranged on the main body. The turning structure usually comprises two rotary limiting catches configured outside the water connection pipe and a poke rod configured on one side of the main body and extending downward to be between the two limiting catches. When the main body starts to rotate under the drive of the swinging frame, the poke rod will be driven to contact one of the limiting catches, so that the poke rod will deflect and drive the inner mechanism to turn the main body. However, as the poke rod of such a conventional impingement sprinkler is located between the two limiting catches, and there are no other limiting structures around the two limiting catches, when the main body slants upward, there is a possibility that the poke rod may go beyond the limiting catches and cannot touch each other, and consequently, the main body loses the turning function and cannot conduct the recycling irrigation. This will naturally cause uneven irrigation and the convenient and practical functions of the impingement sprinkler are greatly reduced.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The main characteristic of the "impingement sprinkler" disclosed by the present invention is that the first and second limiting pieces of the rotation limiting mechanism are configured with first and second stopping portions extending along the swinging path, so that when the main body slants upward or downward, the poking rod portion can always contact the first and second stopping portions, and therefore the first or second limiting pieces can interfere with the poking rod portion and maintain the function of the main body to shift turning directions. In this way, no matter whether the main body slants upward or downward, it can substantially execute the turning action to sprinkle the surroundings. Hence, the practical utility and usage convenience of the product is greatly enhanced.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
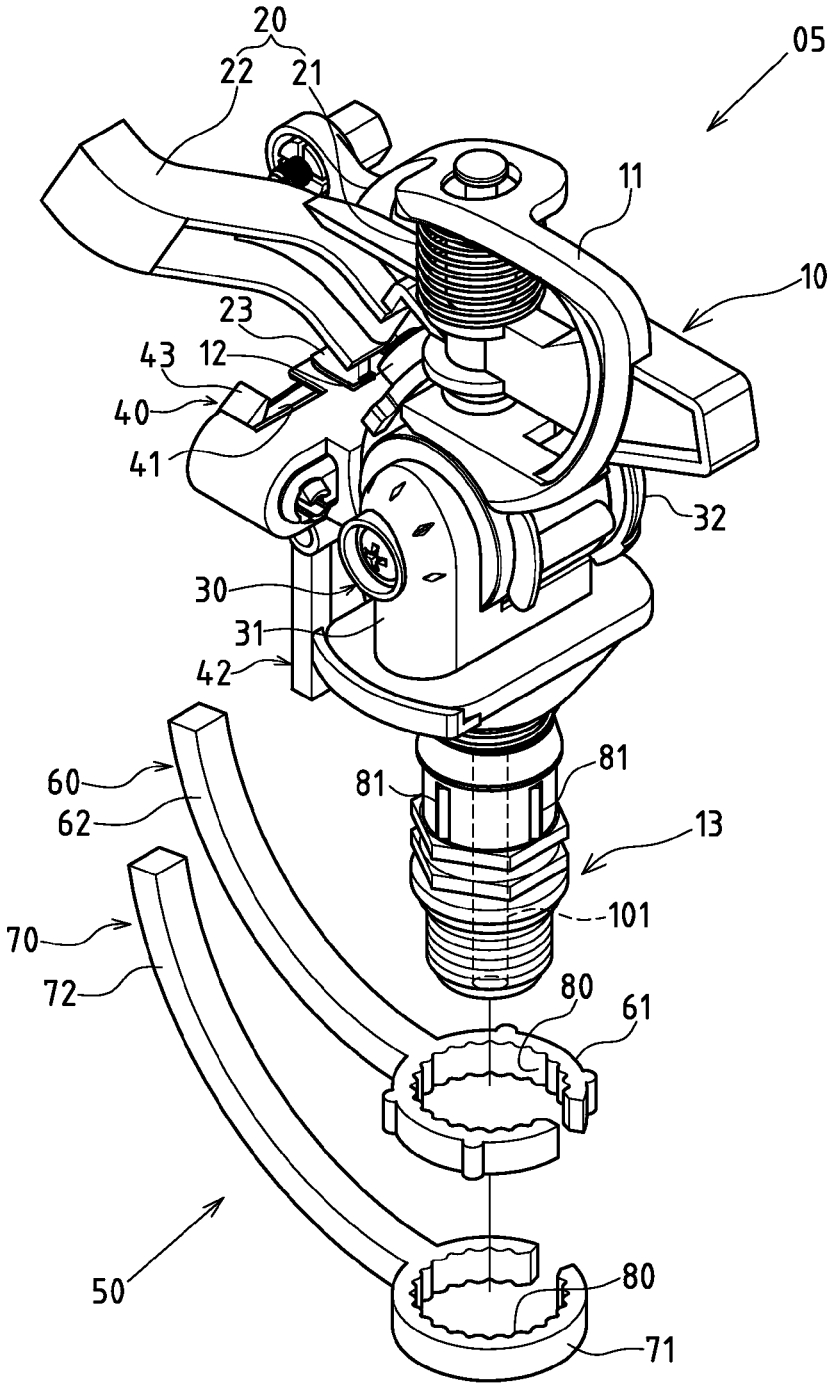
FIG. 1 is an exploded perspective view of the present invention.

FIGS. 1 to 5 depict a preferred embodiment of the impingement sprinkler of the present invention. However, such an embodiment is illustrative only and is not intending to limit the scope of patent application.

The impingement sprinkler 05 includes a main body 10, comprising a frame portion 11, and a sprinkler head 12 configured at a position close to the lower edge of the frame portion 11, wherein the lower end of the main body 10 has an axle tube 101, and the axle tube 101 can be attached with an attaching seat 13.

A rotation guiding mechanism 20 is configured on the frame portion 11 of the main body 10 and comprises a torsional spring 21 and a swinging piece 22, wherein one side of the swinging piece 22 has a first contacting portion 23, and the swinging piece 22 corresponds to the interval on the front end of the sprinkler head 12. Wherein, the attaching seat 13 on the lower end of the main body 10 is to be connected with a water pipe (not shown in the drawing), so that water source can go through the attaching seat 13 into the axle tube 101 and frame portion 11, and then spray out from the sprinkler head 12, and the water sprinkled out will drive the swinging piece 22 for reciprocating swinging (the swinging state of the swinging piece 22 is not shown in the drawing), and consequently drive the main body 10 to turn.

Figure 4:
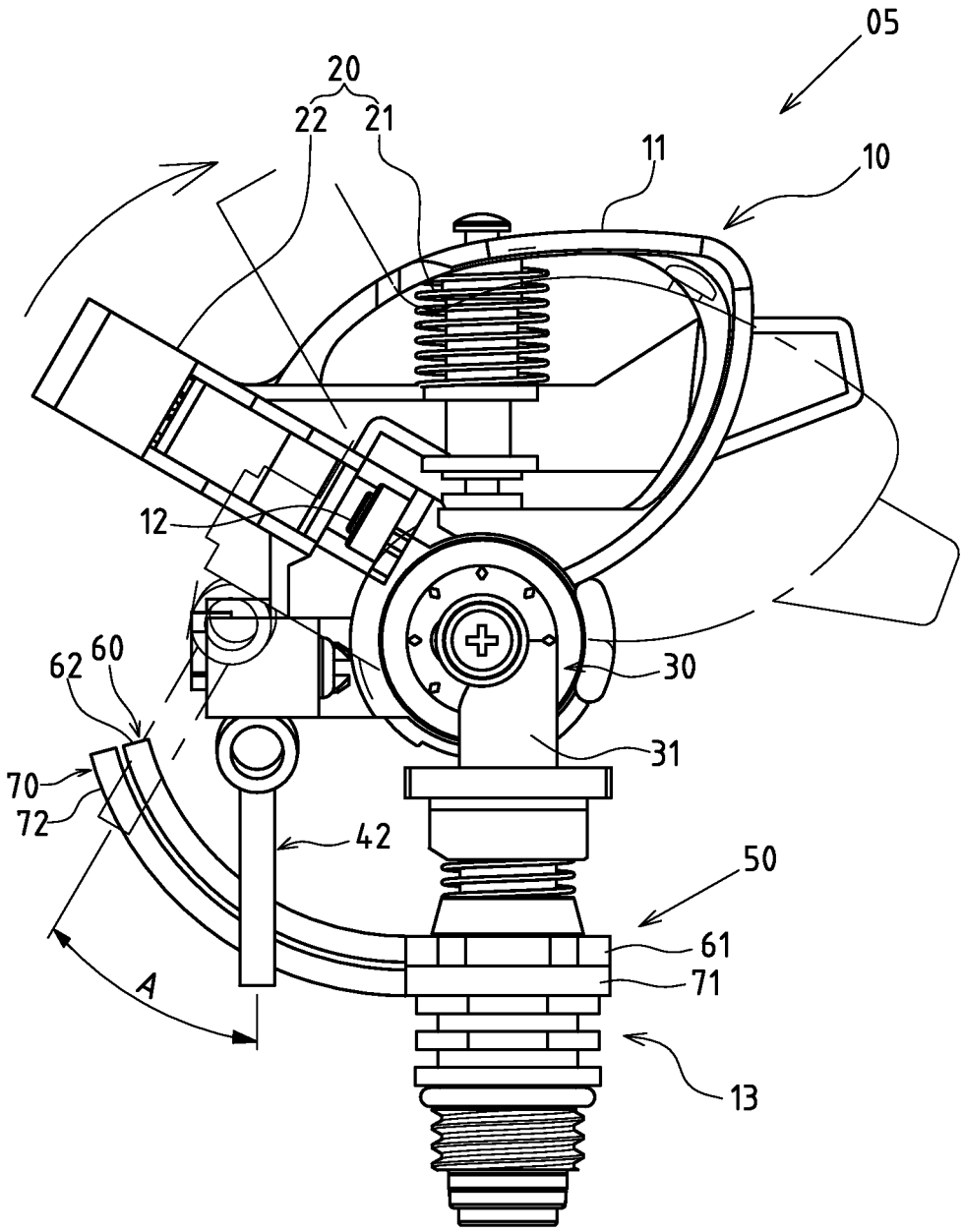
FIG. 4 is an action schematic diagram when the slanting angle of the present invention is adjusted upward.
Figure 5:
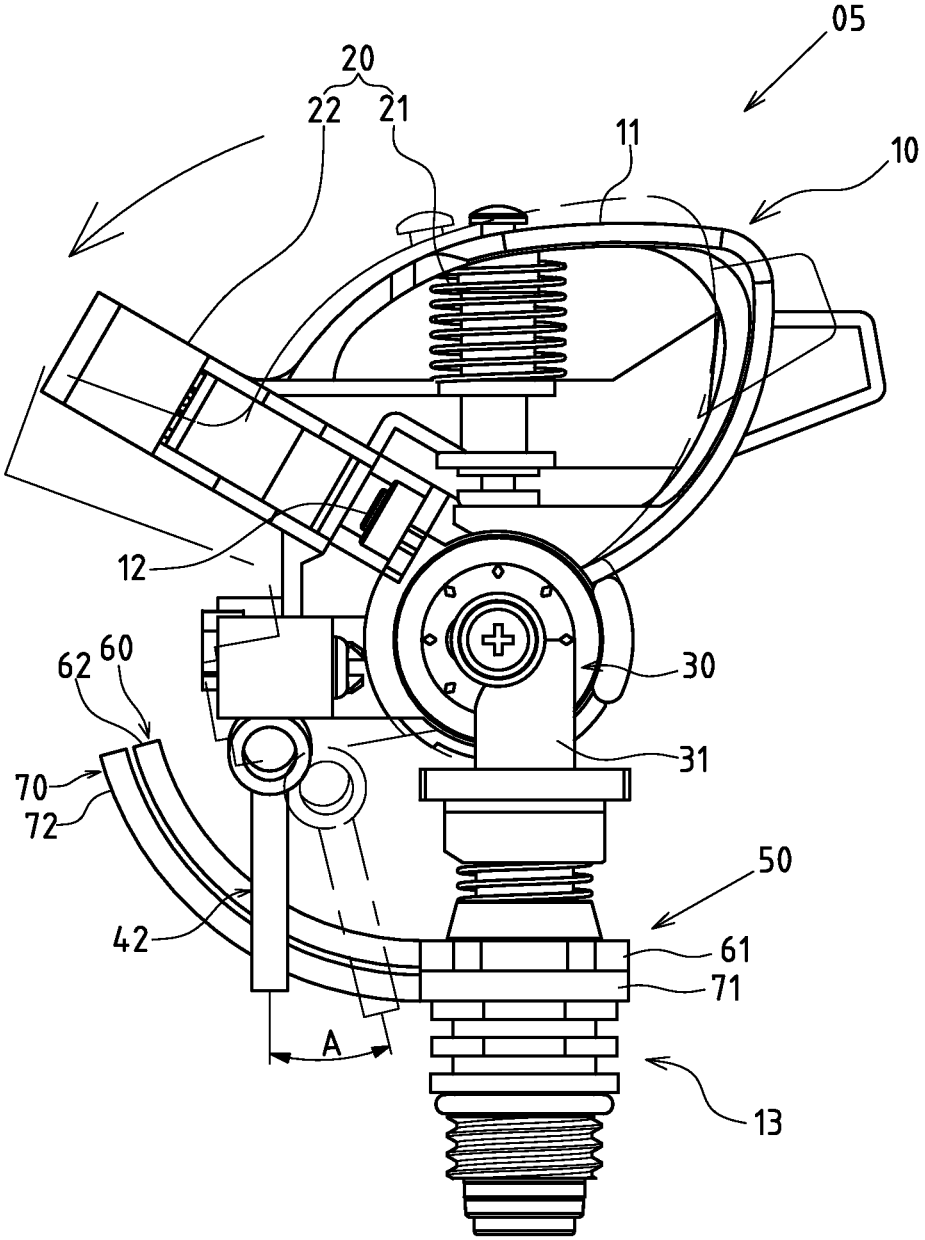
FIG. 5 is an action schematic diagram when the slanting angle of the present invention is adjusted downward.

A slant adjustment mechanism 30 is provided between the frame portion 11 and attaching seat 13 of the main body 10, so that the slanting angle of the main body 10 can be adjusted and the water sprinkling angle of the sprinkler head 12 can be changed (refer to FIGS. 4, 5).

Figure 3:
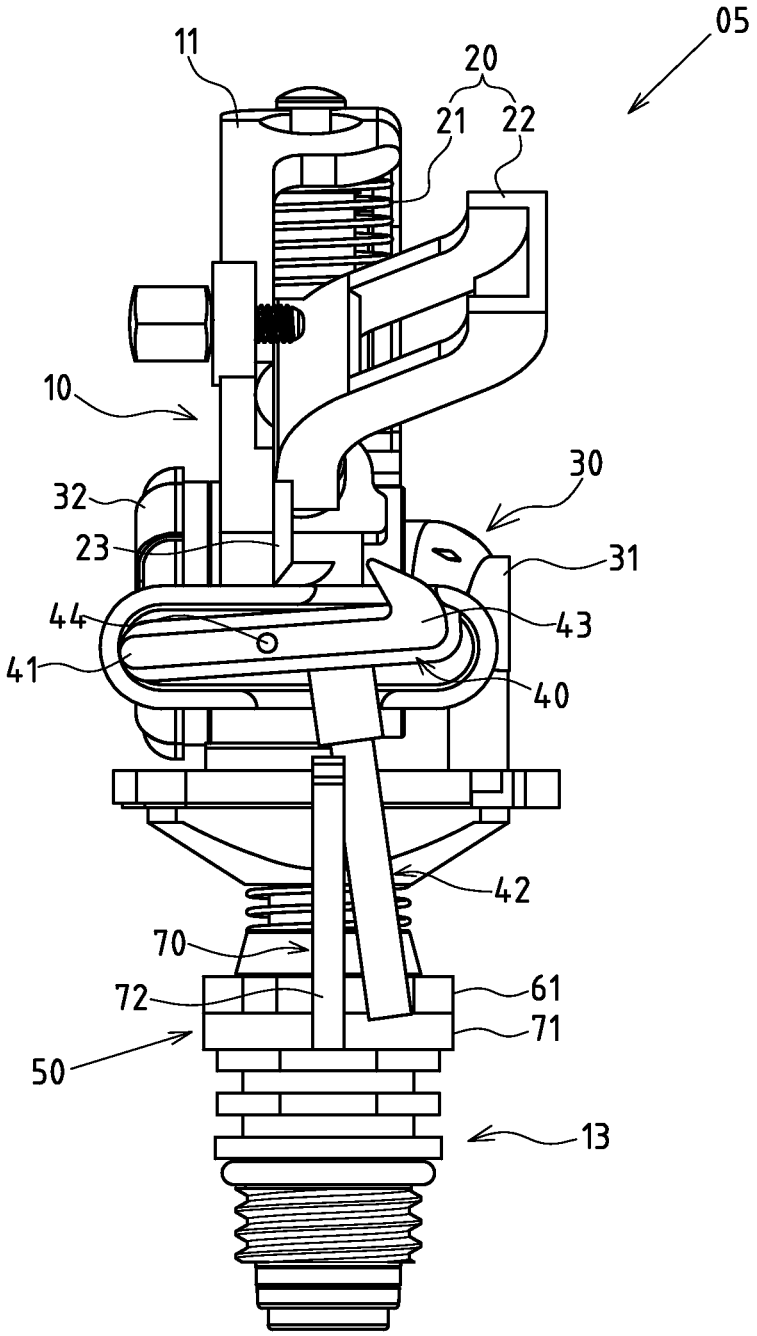
FIG. 3 is a side view of the present invention.

A turning control component 40 is configured on one side of the frame portion 11 of the main body 10, and comprises a second contacting portion 41 and a poking rod portion 42 configured on the lower side of the second contacting portion 41, capable of swinging and extending downward. Movement of the poking rod portion 42 will drive the second contacting portion 41 and first contacting portion 23 to become aligned or misaligned, so that the turning direction of the main body 10 can be changed, and when the slanting angle of the main body 10 is adjusted, the poking rod portion 42 will slant along with the main body 10 and forms a swinging path A (refer to FIGS. 4, 5). Moreover, the first contacting portion 23 disclosed in the present embodiment is configured on the bottom of the swinging piece 22 in the shape of a hooking block, while the second contacting portion 41 is Configured on one side of the frame portion 11 of the main body 10 in the shape of a long block, and one end of the second contacting portion 41 is formed with a hooking portion 43 aligned to the first contacting portion 23. Moreover, the center of the second contacting portion 41 is configured with as pivot 44 (only shown in FIG. 3), and through left or right swinging of the poking rod portion 42, the second contacting portion 41 can be controlled to swing around the pivot 44, so that the hook portion 43 will be elevated to be aligned with the first contacting portion 23 or lowered to be misaligned with the first contacting portion 23 (as shown in FIG. 3, the hook portion 43 is aligned with the first stopping portion 23).

A rotation limiting mechanism 50 is provided on a preset position of the attaching seat 13 to limit and interfere with the poking rod portion 42, further comprising: a first limiting piece 60, attached to the outside of the attaching seat 13 and defining, an attaching portion 61 and a first stopping portion 62 extending from one side of the attaching portion 61 to the swinging path A of the poking rod portion 42; and a second limiting piece 70, attached to the outside of the attaching seat 13 and located over or beneath the first limiting piece 60. The second limiting piece 70 forms a sleeving portion 71 and a second stopping portion 72 extending from one side of the sleeving portion 71 to the swinging path A of the poking rod portion 42, wherein the first and second limiting pieces 60, 70 can both be adjusted by rotating around the attaching seat 13 (refer to FIGS. 6, 7), so as to limit the rotation range of the main body 10.

In this way, through the first and second stopping portions 62, 72 configured on the first and second limiting pieces 60, 70, when the main body 10 slants upward or downward, the poking rod portion 42 can always contact the first and second stopping portions 62, 72, so that the first limiting piece 60 or second limiting piece 70 can interfere with the poking rod portion 42 to maintain the function of the main body 10 to shift its turning direction, and avoid the problem that the main body 10 cannot shift its turning direction because the poking rod portion 42 cannot contact the first and second limiting pieces 60, 70 when the main body 10 slants upward or downward.

Figure 8:
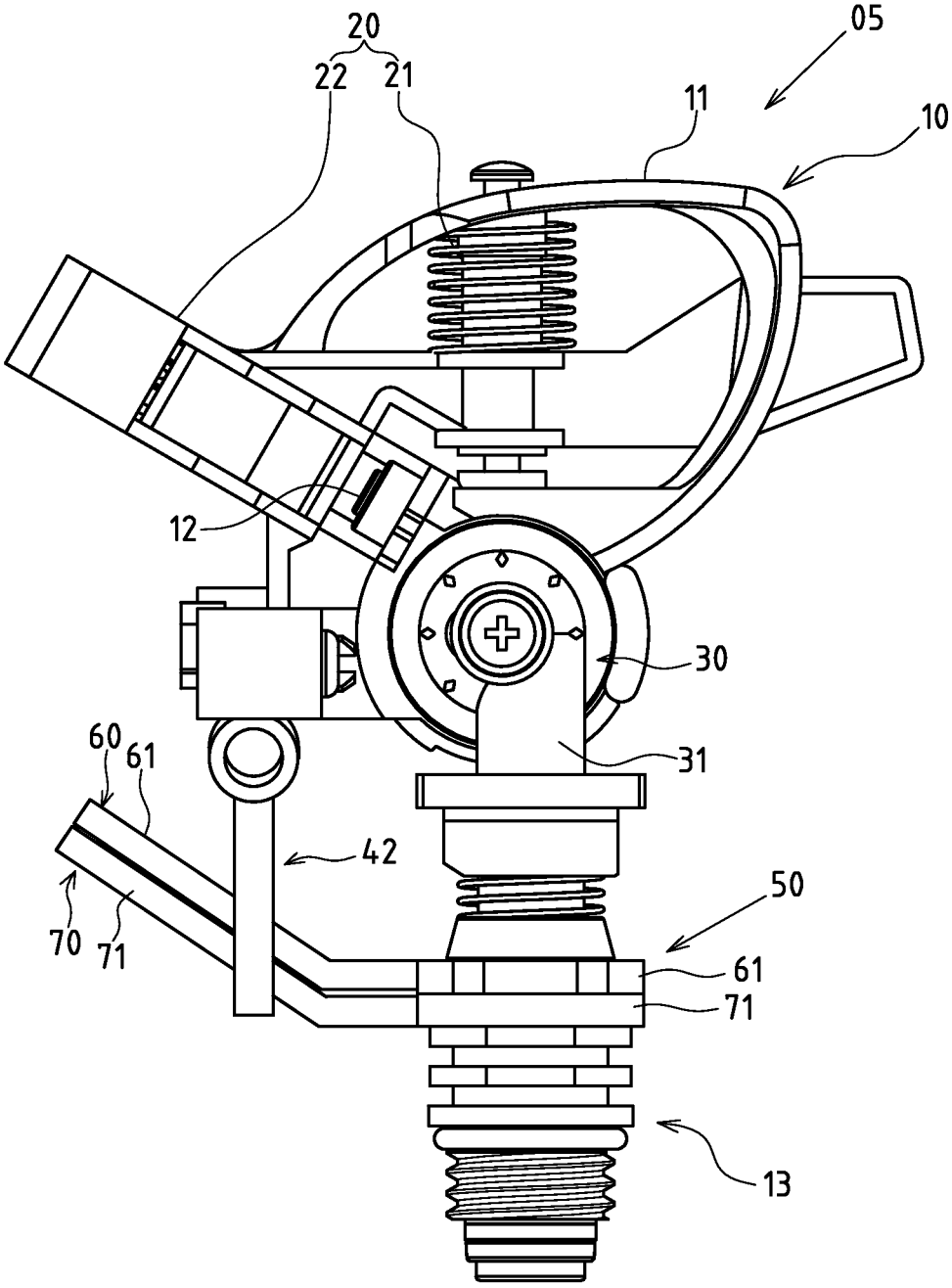
FIG. 8: a plane view of another embodiment of the rotation limiting mechanism of the present invention.

Below is a description of the implementation and operation of the present invention:

Referring to FIG. 4, the first and second stopping portions 62, 72 configured on the first and second limiting pieces 60, 70 disclosed in the present invention are in a curved and extending form, and the curve extends along the swinging path A formed by the poking rod portion 42 when the main body 10 is slanted, so that not matter the main body 10 is slanted upward or downward, the poking rod portion 42 can always contact the first and second stopping portions 62, 72, or, as shown in FIG. 8, the first and second stopping portions 62, 72 are in a slanted and extending form, the same function can be achieved.

Figure 6:
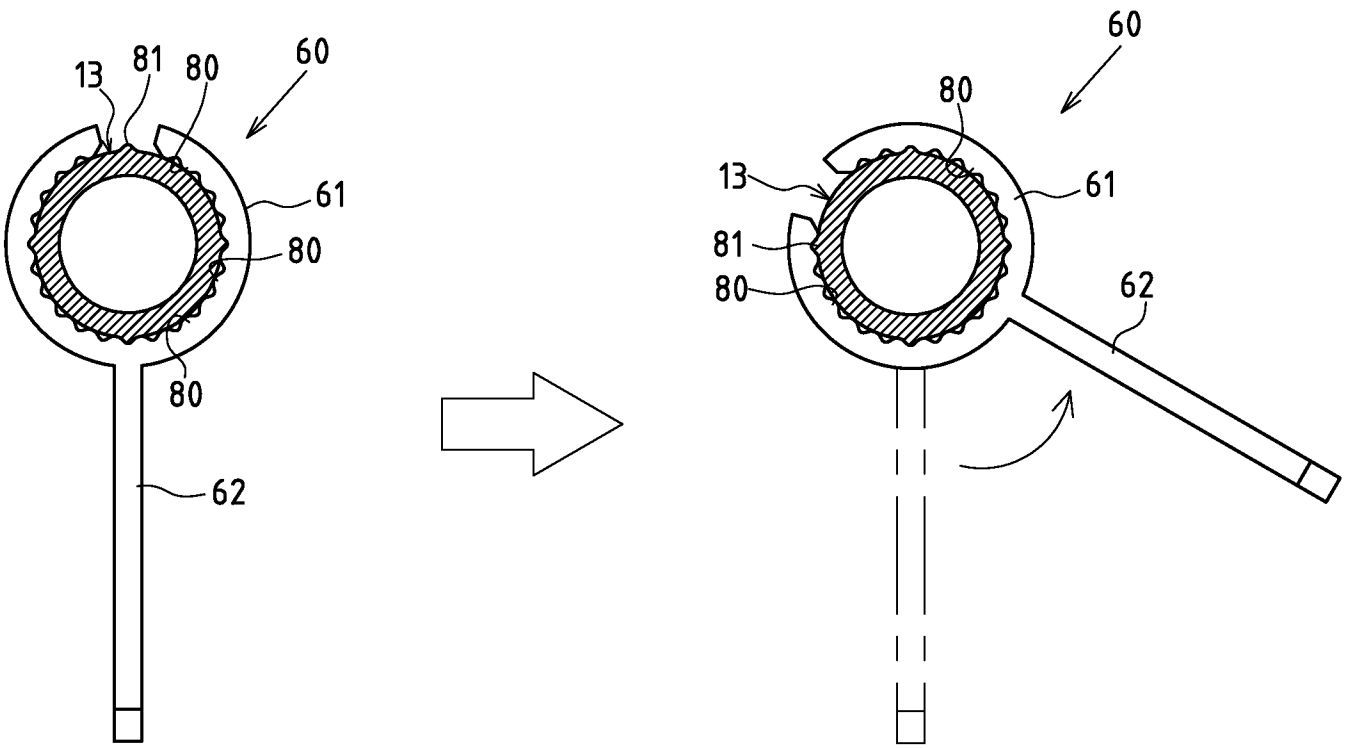
FIG. 6 is an action schematic diagram when the first limiting piece of the present invention rotates around the attaching seat.
Figure 7:
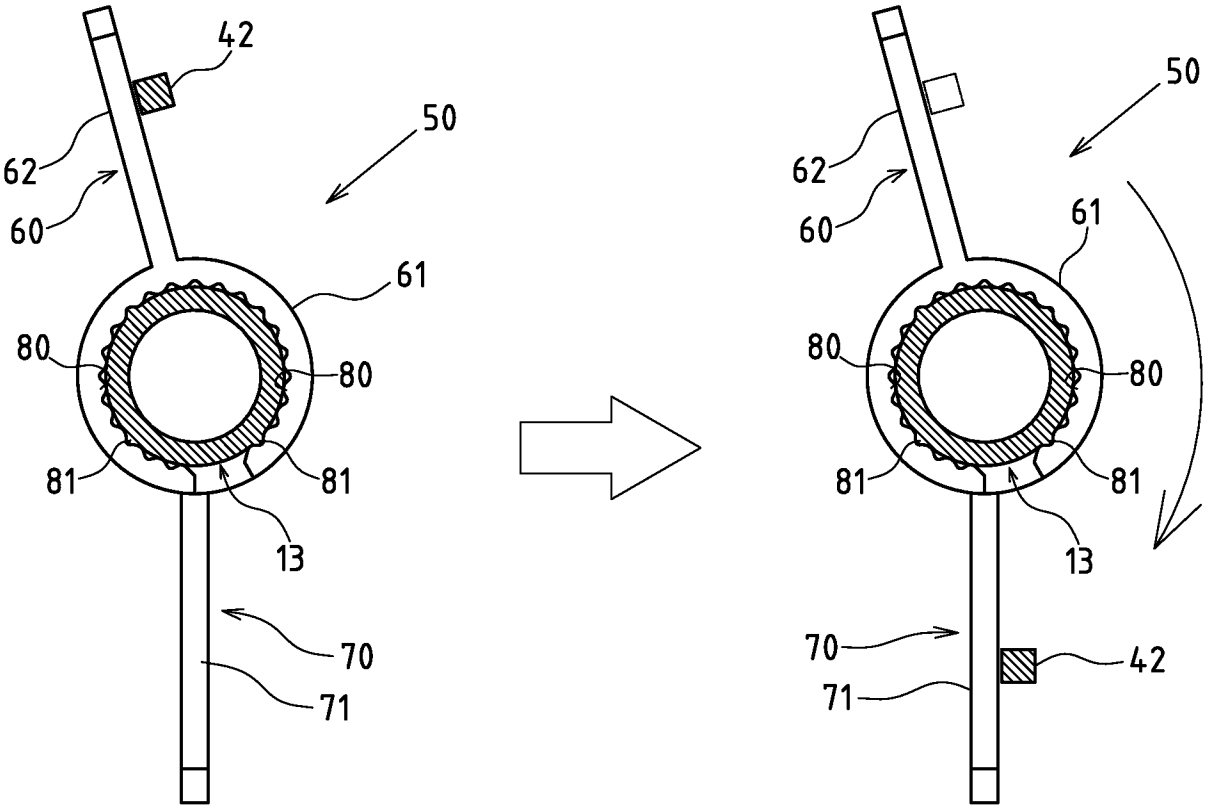
FIG. 7 is an action schematic diagram when the rotation limiting mechanism of the present invention contacts and interferes with the poking rod portion.

Referring to FIGS. 6 and 7, in the present embodiment, the inner side of the attaching portion 61 on the first limiting piece 60 and the sleeving portion 71 on the second limiting piece 70 are configured with a plurality of positioning teeth 80 distributed with intervals, and the outer side of the attaching seat 13 is correspondingly configured with at least one edge 81, so that when the first and second limiting pieces 60, 70 are adjusted, they can be positioned by stages.

Figure 2:
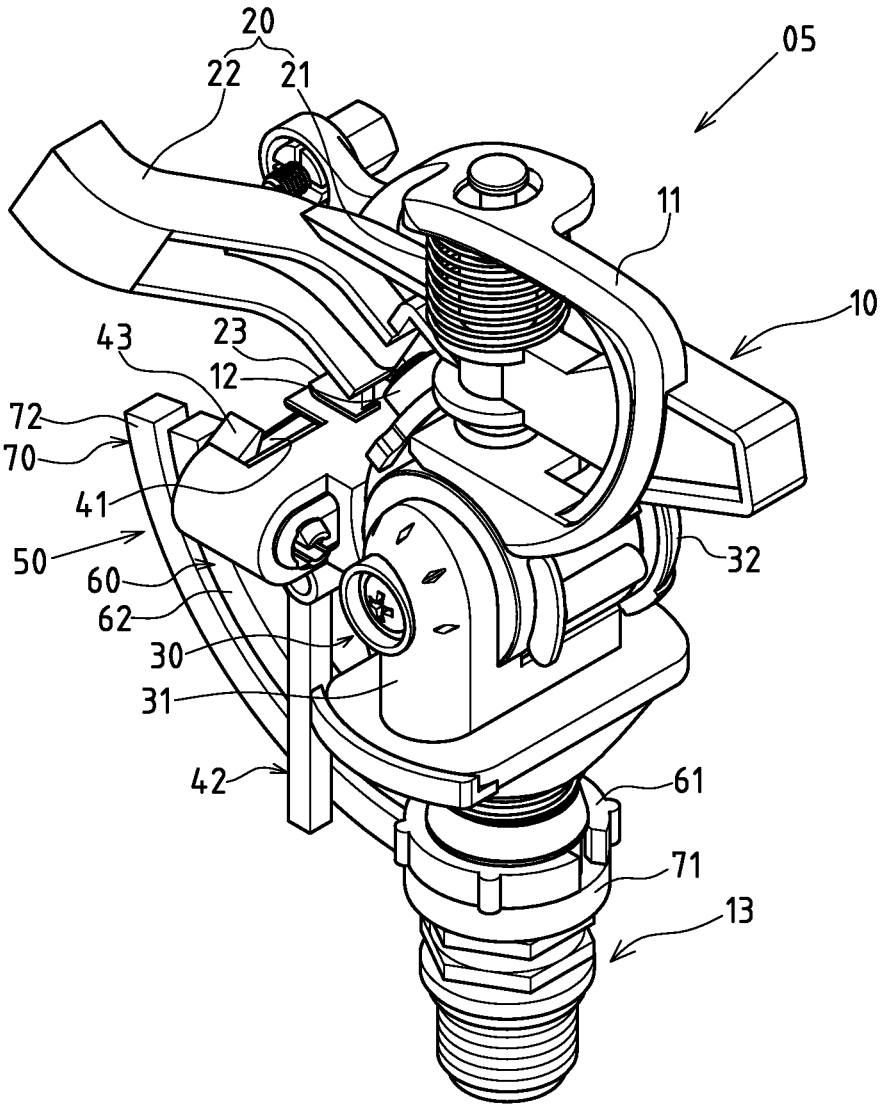
FIG. 2 is a combined perspective view of the present invention.

Referring to FIGS. 2 and 4, the slant adjustment mechanism 30 comprises an axle seat 31 configured on top of the attaching seat 13 and a pivot portion 32 which can be correspondingly attached to the axle seat 31. Wherein, the axle seat 31 can be attached to one side of the frame portion 11 of the main body 10, and the pivot portion 32 can go through the frame portion 11 and be pivoted with the axle seat 31, so that the main body 10 can be rotated around the pivot portion 32, and the sprinkling angle of the sprinkler head 12 can be changed. When the main body 10 is slanted upward (referring to FIGS. 4, 7), as the first and second stopping portions 62, 72 of the first and second limiting pieces 52, 53 are extending along the swinging path A of the poking rod portion 42, no matter the main body 10 is adjusted to any slanting angle, the poking rod portion 42 can always contact and interfere with the first and second stopping portions 62, 72, or, as shown in FIG. 5, when the main body 10 is slanted downward, the poking rod portion 42 can also contact and interfere with the first and second stopping portions 62, 72. Therefore, the main body 10 can always maintain the function to shift its rotation direction, and can substantially execute the sprinkling action in the surrounding area.

I claim:

1. An impingement sprinkler comprising:

a main body having a frame portion and a sprinkler head configured at a position adjacent to a lower edge of the frame portion, wherein a lower end of said main body has an axle tube, said axle tube adapted to be attached with an attaching seat;

a rotation guiding mechanism positioned on said frame portion of said main body, said rotation guiding mechanism having a torsional spring and a swinging piece, wherein one side of said swinging piece has a first contacting portion, and wherein said swinging piece corresponds to a space on a front end of the sprinkler head;

a slant adjustment mechanism positioned between said frame portion and said attaching seat of said main body such that a slanting angle of said main body can be adjusted and a water sprinkling angle of the sprinkler head can be changed;

a turning control component arranged on one side of said frame portion of said main body, said turning control component having a second contacting portion and a poking rod portion arranged on a lower side of said second contacting portion, said turning control component capable of swinging and extending downward, a movement of said poking rod portion driving said second contacting portion and said first contacting portion so as to become aligned or misaligned such that a turning direction of said main body can be changed, said poking rod portion slanting along with said main body and forming a swinging path when the slanting angle of said main body is adjusted;

a rotation limiting mechanism positioned on a preset position of said attaching seat so as to limit and interfere with said poking rod portion, said rotation limiting mechanism comprising:

a first limiting piece attached to an outside of said attaching seat and defining an attaching portion and a first stopping portion extending from one side of said attaching portion to the swinging path of the poking rod portion; and a second limiting piece attached to the outside of the attaching seat and located over or beneath said first limiting piece, the second limiting piece forming a sleeving portion and a second stopping portion extending from one side of said sleeving portion to the swinging path of said poking rod portion, wherein the first and second limiting pieces can both be adjusted by rotation around the attaching seat, said first and second stopping portions of said first and second limiting pieces extending upwardly at a slanted angle, said poking rod portion always contacting said first and second stopping portions such that said first limiting piece or said second limiting piece can interfere with said poking rod portion so as to allow said main body to shift a turning direction thereof.

2. The impingement sprinkler of claim 1, wherein the first and second stopping portions are of a curved shape and extending outwardly, the curved shape of the first and second stopping portions extending along the swinging path formed by said poking rod portion when said main body is slanted.

3. The impingement sprinkler of claim 1, wherein the first and second stopping portions of the first and second limiting pieces are in a slanted and outwardly extending form.

4. The impingement sprinkler of claim 1, wherein the first and second stopping portions configured on the first and second limiting pieces are of a rod or plate shape.

5. The impingement sprinkler of claim 1, wherein an inner side of said attaching portion on said first limiting piece and said sleeving portion on said second limiting piece have a plurality of positioning teeth distributed in spaced relation to each other, said attaching seat having at least one edge on an outer side thereof, said first and second limiting pieces being adjustable in stages.

6. The impingement sprinkler of claim 1, wherein said slant adjustment mechanism comprises an axle seat configured on top of said attaching seat and a pivot portion which is correspondingly attached to said axle seat, wherein said axle seat is attached to one side of said frame portion of said main body, said pivot portion passable through said frame portion and pivoted with the axle seat such that said main body can be rotated around said pivot portion.

* * * * *